United States Patent [19]

Jaeger

[11] Patent Number: 4,776,376

[45] Date of Patent: Oct. 11, 1988

[54] WOOD SLICING MACHINE

[76] Inventor: Troels A. Jaeger, 106 Wayne Avenue, Scarborough, Ontario, Canada

[21] Appl. No.: 943,785

[22] Filed: Dec. 19, 1986

[30] Foreign Application Priority Data

Dec. 23, 1986 [CA] Canada ..... 498536

[51] Int. Cl.[4] ..... B27L 7/00; B27B 13/10

[52] U.S. Cl. ..... 144/366; 144/162 R; 144/175; 144/193 R

[58] Field of Search ..... 144/193 R, 190, 175, 144/185, 366, 162 R

[56] References Cited

U.S. PATENT DOCUMENTS

| | | | |
|---|---|---|---|
| 3,044,510 | 7/1962 | Schneider | 144/162 R |
| 3,538,966 | 11/1970 | Collins | 144/162 R |
| 3,916,966 | 11/1975 | Johnston et al. | 144/309 |

FOREIGN PATENT DOCUMENTS

| | | | |
|---|---|---|---|
| 982032 | 1/1976 | Canada . | |
| 1044576 | 12/1978 | Canada . | |
| 51764 | 1/1976 | Japan | 144/213 |
| 8601452 | 3/1986 | World Int. Prop. O. | 144/366 |

OTHER PUBLICATIONS

Lumber Production by Slicing by J. S. Johnston and A. St- Laurent Forintek Canada Corp. 1980.

*Primary Examiner*—W. Donald Bray
*Attorney, Agent, or Firm*—George A. Rolston

[57] ABSTRACT

A method of slicing wood by moving a wooden workpiece on a linear path, and forcing one end against a blade directed longitudinally along the grain, applying pressure on both sides of the workpiece, on opposite sides of the blade by means of pressure pads, and, allowing the pressure pads to move relative to the blade, while maintaining equal spacing between themselves, so as to equalize the compressive force on both sides of the workpiece in the region of the blade, and an apparatus for carrying out the method.

Also disclosed is a wood slicing blade with angled cutting edges, which is short and stiff, and a blade holder assembly arranged to tension the blade laterally.

18 Claims, 6 Drawing Sheets

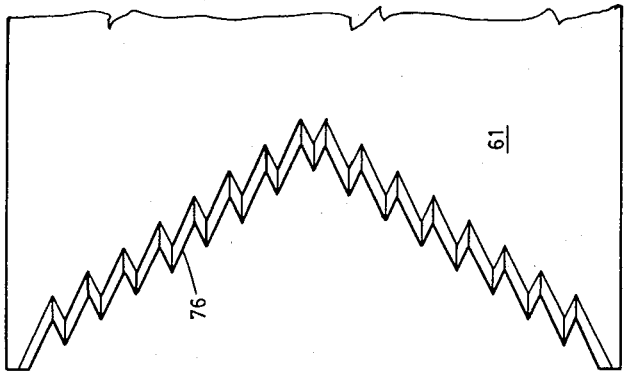
FIG. 13
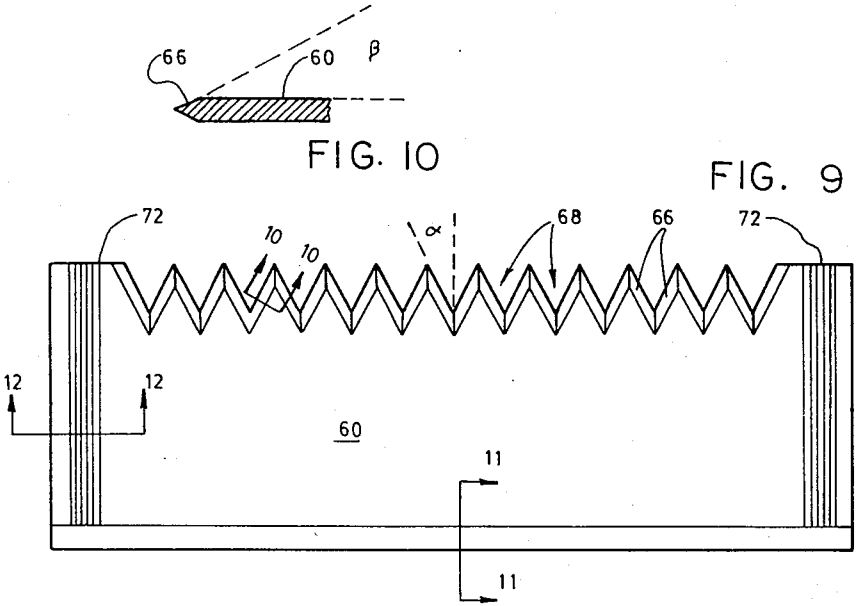
FIG. 9
FIG. 10
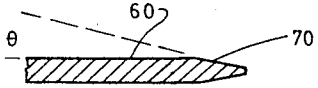
FIG. 11
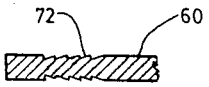
FIG. 12

WOOD SLICING MACHINE

The invention relates to a method and apparatus for slicing wood.

BACKGROUND OF THE INVENTION

Many proposals have been made in the past to slice wood, without the use of a saw.

Such a procedure would have many advantages, the most significant being the saving in wood, since no sawdust or "kerf" will be created.

Examples of such proposals are shown in Canadian Letters Patent Nos. 982032, and 1044576.

The first of such patents relates to the slicing of wood by the process of applying compressive force along the entire extent of both sides of a wood billet or workpiece, and then forcing an elongated blade through the wood in a direction transverse to the longitudinal axis of the wood, and to the direction of the compressive force.

The second patent relates to a process in which a wooden workpiece is passed between two rollers which apply compressive force to opposite sides, and simultaneously force the workpiece against a fixed blade, which progressively slices along the length of the workpiece.

The first proposal is generally speaking unsuitable for mass production techniques in a lumber mill. The second proposal appears to have numerous advantages, and appears to offer attractive possibilities.

In practice however it is found that the nature of the wood itself creates certain serious problems.

The pressure applied to the wooden workpiece is very substantial, up to about 75% of the yield point of the wood. The knife blade must be located between the "footprints" of the two pressure rollers. As a result, it is essential that the unit pressure and the total force on both sides of the wood shall be as far as possible equal and balanced so as to avoid distorting the blade.

In practice it is found that using the technique shown in the patent, it is virtually impossible to maintain equal, balanced forces on both sides of the blade. This is because it is the nature of wood to yield to a varying extent throughout due to its anatomy. Thus if the wood on one side of the blade is soft and the wood on the other side of the blade is harder than the blade will tend to be subjected to higher pressure by the hard side of the wood. The result will be that the whole workpiece with the knife blade inside it attempts to deflect towards the soft side.

Since the hardness of the wood varies along its length, the blade will attempt to flex from one position to another within the wooden workpiece as the wooden workpiece is moved along between the rollers.

Another cause of problems is the presence of surface irregularities and imperfections.

In some cases the wooden billet will have a depression or be "scant" (under size) caused by the operation of the equipment used to prepare it.

In other cases, it will have "wane" (i.e. rounded corner) caused by deformities in the tree trunk itself.

Either case can cause unequal total pressure or force to be exerted on the blade.

The end result is that at the least the slices of wood removed from the workpiece vary in thickness and shape along their length. More seriously, the blade itself frequently becomes damaged and may break.

In spite of lengthy field trials these problems have proved insuperable, and the inventions disclosed in the two patents have not achieved any commercial success.

Accordingly, the present invention has as a general objective the provision of a method, and an apparatus, for slicing wood in which compressive forces are applied from both sides across a wooden billet, and in which the wooden billet is moved on a linear axis along its length against a blade, and in which means are provided for equalizing and balancing the force on both sides of the wood, so as to respond to any variations in the wood along its length.

BRIEF SUMMARY OF THE INVENTION

With a view to overcoming the various disadvantages noted above, and to providing the advantages described, the invention comprises forcing a wooden workpiece constrained to move in a linear path parallel to the intended plane of cutting against a blade directed longitudinally along the grain, applying pressure on both sides of said wooden workpiece, on opposite sides of said blade, by means of pressure pads, and allowing said pressure pads to move relative to said blade, while maintain equal spacing between themselves, whereby to equalize the compressive force on both sides of said wooden workpiece in the region of the blade.

More particularly the invention provides a method having the foregoing advantages wherein the workpiece is guided and constrained by fixed guide means on opposite sides, so as to moved along a defined linear axis, while the pressure pads are free to move relative to the workpiece.

More particularly, it is an objective of the invention to provide a method having the foregoing advantages wherein the pressure pads are linked together for movement in unison with one another whereby when one pressure pad moves towards the wooden workpiece the other pressure pad moves away.

More particularly, it is an objective of the invention to provide a method having the foregoing advantages including the further step of forcing said wooden workpiece against at least one further said blade spaced axially along the line of travel from said first blade , and subjecting said wooden workpiece to pressure on opposite sides thereof in the region of said at least one further blade, said further blade lying in a plane spaced from the plane of said first blade member, whereby to slice said wooden workpiece along multiple parallel spaced apart slicing paths.

It is a further and related objective of the invention to provide an apparatus for carrying out the foregoing method, including a blade mounting means for locating a blade in the path of a wooden workpiece, and two opposed rotatable pressure pads. Located on opposite sides of said wooden workpiece, for applying pressure to opposite sides thereof, moveable mounting means mounting each of said pressure pads for movement towards and away from said workpiece, and force equalizing means operatively coupled to said pressure pads for equalizing force on both sides of said workpiece.

More particularly it is an object of the invention to provide an apparatus having the foregoing advantages including link means operatively connecting said pressure pads, whereby they are moveable in unison, while maintaining equal spacing therebetween.

More particularly, it is an objective of the invention to provide an apparatus having the foregoing advantages, including adjustment means for adjusting the spacing between said pressure pads and said guide means to accommodate wooden workpieces of different dimensions.

More particularly, it is an objective of the invention to provide an apparatus having the foregoing advantages, including at least one further said blade and at least one further said pairs of pressure pads, spaced apart along the line of travel of said wooden workpiece, and said at least one further blade being located in a plane spaced apart from the plane of said first blade.

It is a further and related objective of the invention to provide a blade apparatus for use in association with the method and apparatus described above wherein the blade defines a plurality of angled blade edges forming a cutting edge.

More particularly, it is an objective of the invention to provide a blade holding means at either side of said blade outside the workpiece, and tension means engaging said holding means whereby said blade is subjected to lateral tension transverse to the axis of travel of said wooden workpiece within the plane of slicing.

More particularly, the blade holder is mounted on a pivot mounting to enable the blade to tilt, to accommodate minor misalignment.

The invention further comprises the provision of a method and apparatus as described designed for slicing logs of a cross-section and dimension varying along their length.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 9 is a plan view of one embodiment of blade;

FIG. 10 is a section along the line 10—10 of FIG. 9;

FIG. 11 is a section along the line 11—11 of FIG. 9;

FIG. 12 is a section along the line 12—12 of FIG. 9;

FIG. 13 is a plan view of an alternate form of blade;

DESCRIPTION OF A SPECIFIC EMBODIMENT

Figure 1:
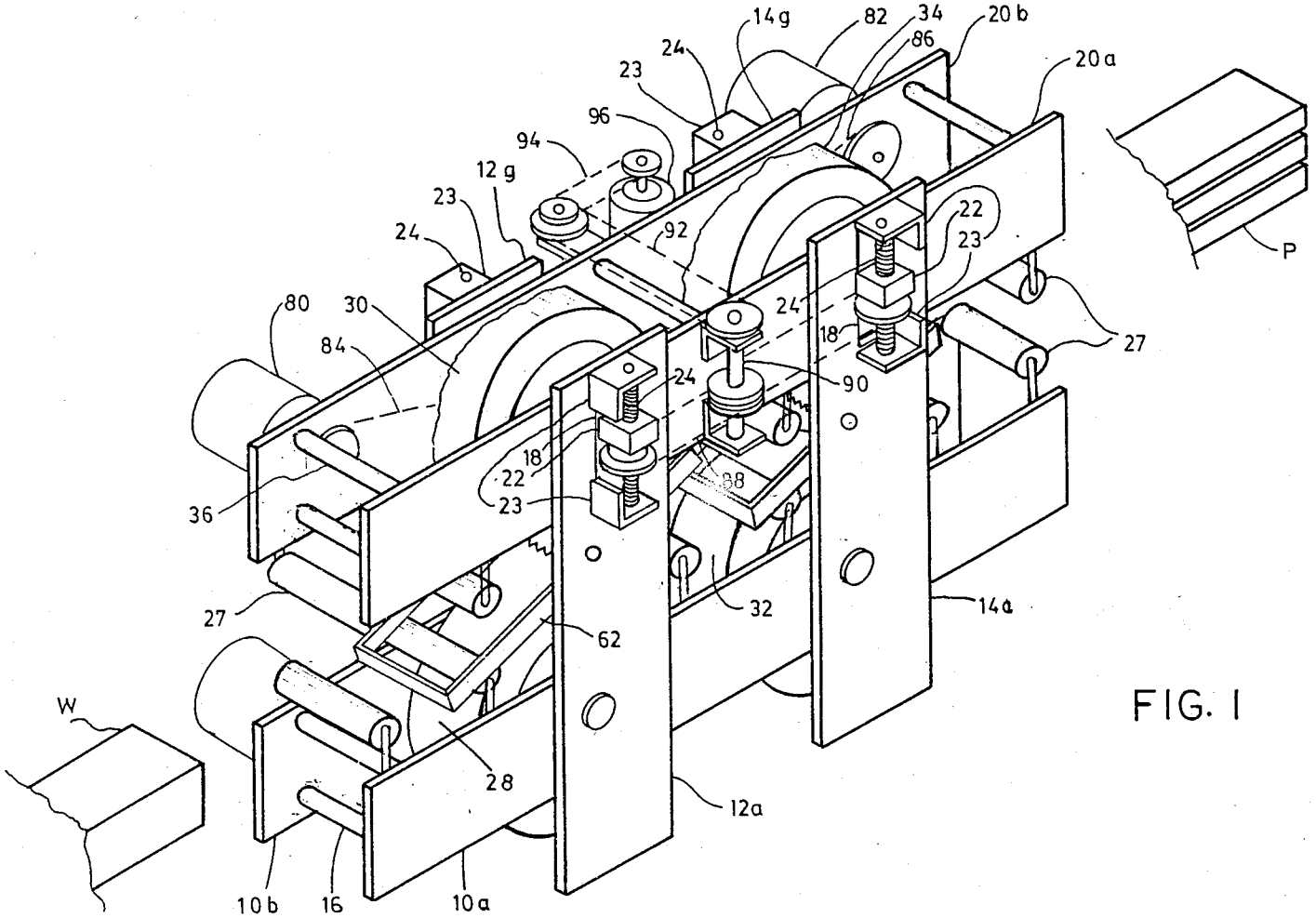
FIG. 1 is a perspective illustration partially cut away, showing a wood slicing apparatus in accordance with the invention.
Figure 2:
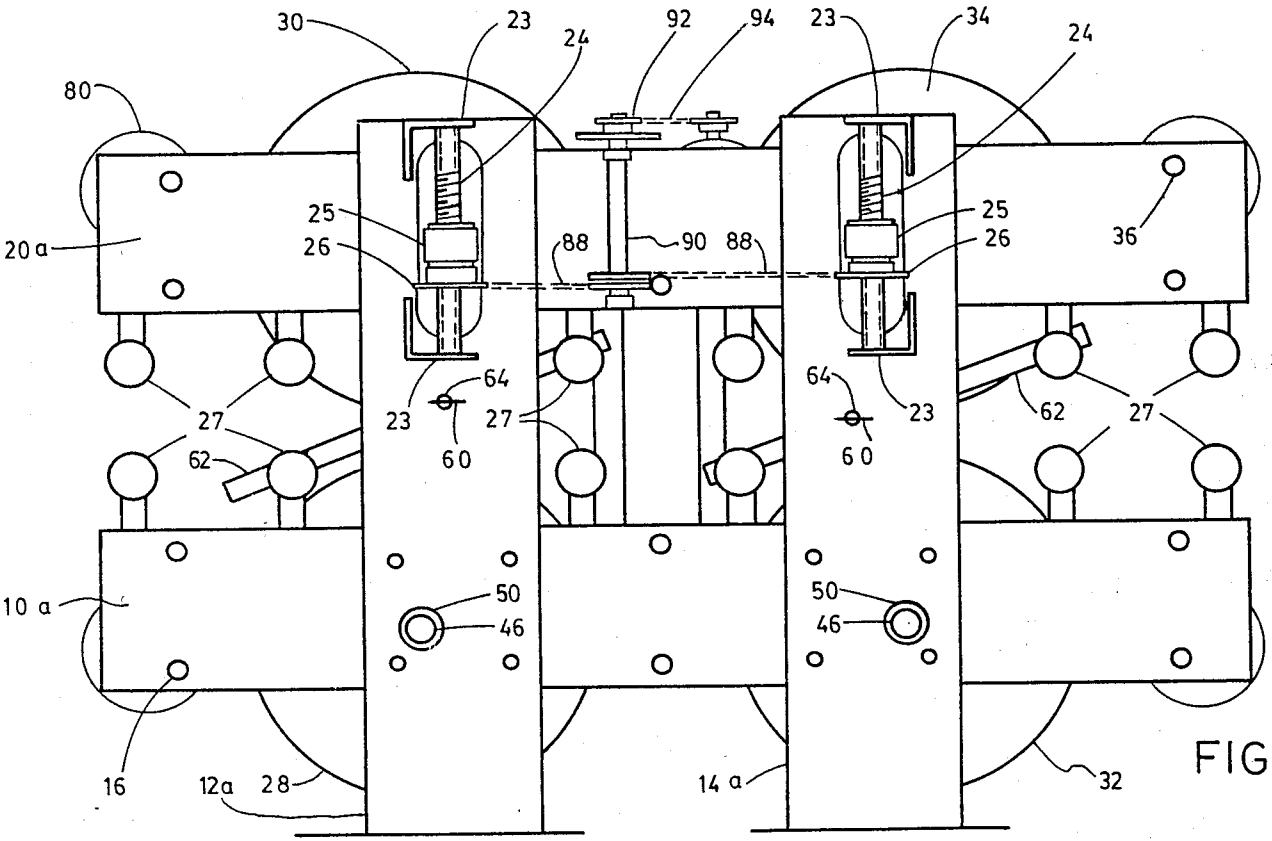
FIG. 2 is a schematic side elevation showing the machine of FIG. 1, with parts shown in phantom and parts cut away.

Referring first of all to FIGS. 1 and 2, the invention is illustrated, as being embodied in a wood slicing machine, for slicing a large rectangularly shaped billet or "cant" of wood indicated generally as W.

Typically, this cant or workpiece will have been cut in a typical lumber mill, so as to provide dimensions of 6" by 6".

Typically, the invention would slice a 6" by 6" cant in two planes so as to provide three wooden planks indicated generally as P, having dimensions of 2" by 6".

It will of course be appreciated that the invention is not limited to a wooden workpiece having these dimensions, nor is it limited to cutting to these dimensions, these dimensions having been mentioned here merely for the sake of illustration.

The slicer embodying the invention comprises a pair of lower frame members 10A–10B, to which are bolted two pairs of upright frame members 12A, 12B and 14A, 14B.

The lower horizontal frame members 10 are secured together by means of transverse members 16.

The vertical frame members 12 and 14 are provided at their upper ends with elongated slots 18 for purposes to be described below.

A pair of upper moveable frame members 20A, 20B are moveably mounted between the side members 12 and 14. Bearing blocks 22 are secured to the exterior of the upper frame members 20, and extend through slots 18.

Figure 4:
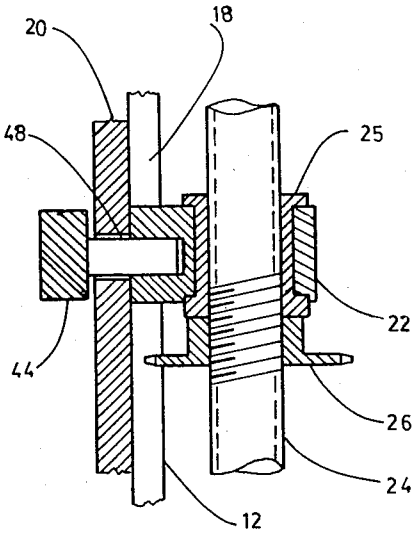
FIG. 4 is a section along the line 4—4 of FIG. 2.

Upper and lower mounting brackets 23 are fastened to the exterior of the side members 12 and 14 in registration with slots 18. Threaded rods 24 are secured at both ends in mounting brackets 23. Rods 24 pass through nuts 25 (FIG. 4) mounted in blocks 22. Nuts 25 are rotatable by means of sprockets 26 attached thereto.

Rotation of nuts 25 will cause blocks 22 and frames **20*a*, 20*b* to rise, or fall, on rods 24, in this way the frame members 20A and 20B can be raised or lowered relative to the side members 12 and 14 to set the spacing between members 10 and 20**.

This provides for adjustment to suit the vertical cross dimension of the wooden workpiece W.

Guide rollers 27 are adjustably mounted on lower and upper frame members 10 and 20. Their purpose is to contact the upper and lower surfaces of the workpiece and hold it against vertical displacement.

The use of upper and lower guide rolls is merely one example of a means of guiding the workpiece on a defined linear path.

Other guide means could be provided such as any machined plane surface, for one side of the workpiece, and any suitable holder, e.g. a series of pressure wheels or roller, on the other side, pressing the workpiece onto the plane surface.

Side guides (not shown) will also be provided in most cases.

In order to apply pressure to both sides of wooden workpiece W pressure means are provided which in this embodiment comprise two pairs of pressure rolls are provided indicated as lower and upper first rolls 28 and 30 and lower and upper second rolls 32 and 34.

It will be understood that the pairs of rolls function in essentially the same way as each other, and that two such pairs of rolls are provided so as to provide sufficient traction and to enable the wood workpiece W to be sliced in at least two different places.

Normally, if all that is required is a single slice then only one pair of rolls need be provided, or at all events only one pair of such rolls would normally be used.

Conversely if more slices are required in some cases then further pairs of such pressure rolls may also be provided.

It should also be noted that in the design of the machine the first and second pairs of rolls are spaced apart axially along the length of the wooden workpiece so as to apply pressure thereto at different locations. The reasons for this will become apparent from the following description.

The upper frame members 20A and 20B are secured to one another by means of transverse members 36 similar to members 16.

Figure 3:
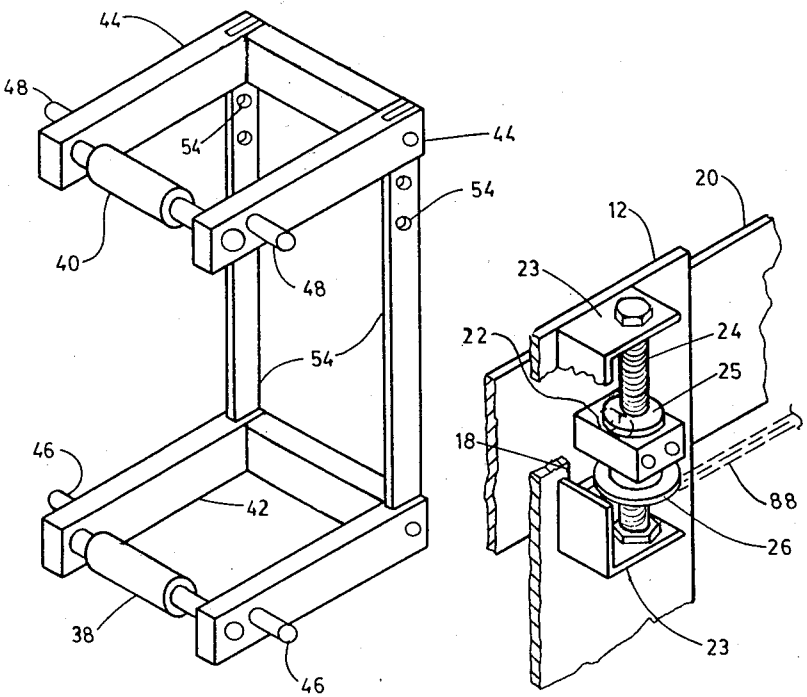
FIG. 3 is a schematic exploded view of one pair of pressure pad assemblies.

The mounting of the pressure rolls 28 and 30, and 32 and 34 is shown in more detail in FIGS. 2 and 3.

As explained above, in this embodiment of the invention the total pressure (i.e., the force) is equalized or balanced between the upper and lower rolls in each pair, by permitting the rollers to move upward and downward relative to the workpiece, and by operatively coupling the two rolls together so that when the one roll senses a reduction in total pressure or force it may move slightly closer to the workpiece, thereby permitting the other roll to move slightly further away.

By this general principle, any local irregularity in the wood which might otherwise result in unequal total pressures or force, will simply permit the rolls to move slightly thereby equalizing and balancing the pressure on both sides of the wood.

Clearly, this function could be achieved in various ways such as by means of a hydraulic system, or possibly by pneumatic means or electrical means.

For the sake of simplicity in the present embodiment however the coupling is a purely mechanical system as illustrated in FIG. 3.

In this system, referring for example to rolls 28 and 30, each of the rolls 28 and 30 is mounted on its own axle 38 and 40, which will extend through the roll and outwardly on opposite sides. On each side of the roll, a tilt bar 42 and 44 is provided, with the axle 38 and 40 being supported at one end of the tilt bar.

Spaced somewhat along the tilt bar from the roll axle 38 and 40 is a pivot stub axle 46 and 48, which is received in a suitable bearing 50 and 52 mounted in the lower and upper frame members 10 and 20 (FIG. 2).

It will of course be appreciated that there are axles 38 and 40 and tilt bars 42 and 44 and pivot stub axles 46 and 48 and bearings 50 and 52 on both sides of each of the pairs of rolls.

The opposite ends of the tilt bars 42 and 44 are operatively coupled together by means of links 54, so that the tilt bars 42 and 44 must swing about the pivot stub axles 46 and 48 in unison.

Links 54 have length adjustment means, in this case being the spaced holed 55, by which they can be effectively altered in length.

Links 54 are swingably attached to tilt bars 44 so that the entire assembly can swing in unison about pivot axles 46–48, while maintaining equal spacing between axles 38–40.

The rolls 28, 30, 32, 34, are provided with inflated tires indicated generally as 56, essentially similar to automobile tires. The interior of the tires is inflated to a pressure typically near to but just below 75% of the wood's yield point. The spacing between the rolls 28 and 30 is then adjusted in a manner described below, so that when the wood workpiece is forced between them a predetermined unit pressure is applied uniformly over the contact area over a desired length or "footprint".

It will readily be appreciated that any irregularities in the shape or hardness of the wood will result in the rolls immediately compensating by moving slightly in one direction or the other.

Any inward movement of one of the rolls will immediately be compensated by a slight outward movement of the other roll.

The spacing between the pairs of rolls will be somewhat less than the spacing between the guides 27 which control the workpiece.

Normally, the spacing between the rolls will be preset, by adjusting the length of links 54, so as to obtain the desired footprint length. Once preset, this can be left virtually unchanged.

Even if the upper frame members 20 are moved up or down to accommodate wood of different dimensions typically over a range of 3 inches, no further adjustment is likely to be necessary.

This is because the distance between the roll axles and the pivot stub axles is small in relation to the distance between the stub axles and the links 54.

By this feature of the invention it will thus be seen that the upper and lower rolls in each pair are essentially free floating and coupled together. They are thus free to follow the contours of the wooden workpiece and to respond to irregularities in hardness along its length without the requirement for the operation of exterior controls.

Figure 5:
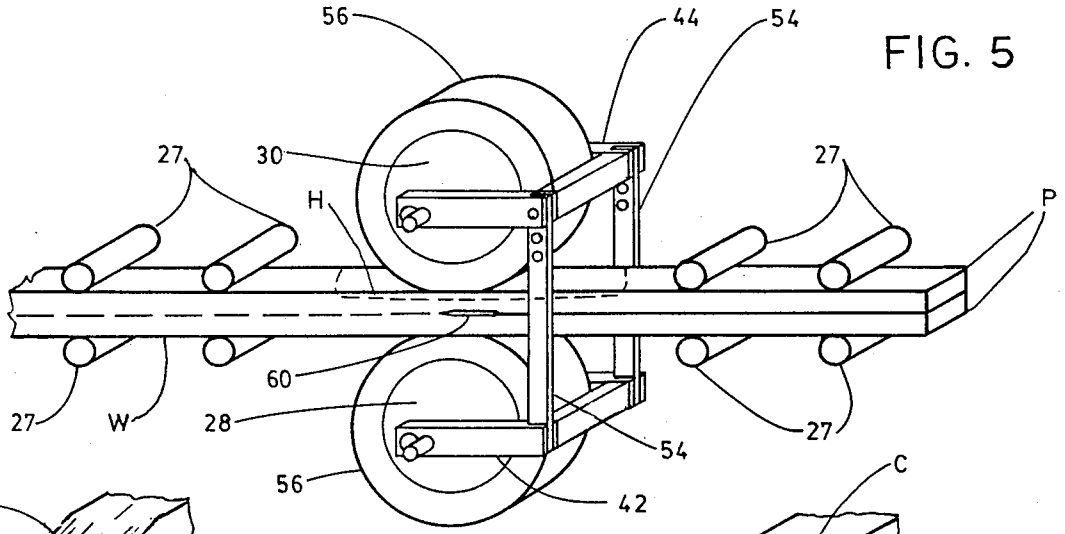
FIG. 5 is a schematic perspective of a wooden workpiece exhibiting areas of varying hardness.
Figure 7:
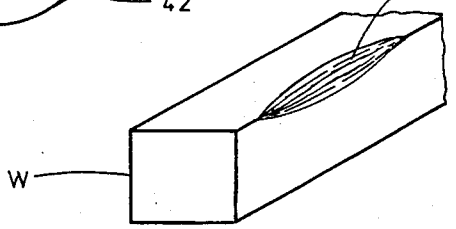
FIG. 7 is a perspective of a workpiece exhibiting a region which is "scant"
Figure 6:
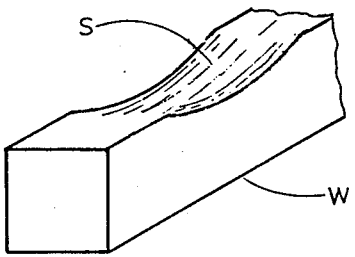
FIG. 6 is a perspective of a workpiece exhibiting a region which is "wane"

Typical irregularities are illustrated in FIGS. 5, 6 and 7. FIG. 5 illustrates variations in hardness at H, FIG. 7 illustrates "scant" at S and FIG. 6 illustrates a contour at C which is "wane".

In the prior art slicing machine, any of these conditions would cause the rolls to exert unbalanced forces. In the present invention, by the use of fixed guides controlling the workpiece, and floating pressure means, these forces are automatically balanced out.

In order to slice the wooden workpiece lengthwise, a slicing blade is mounted between the "footprints" of the upper and lower rolls.

Figure 8:
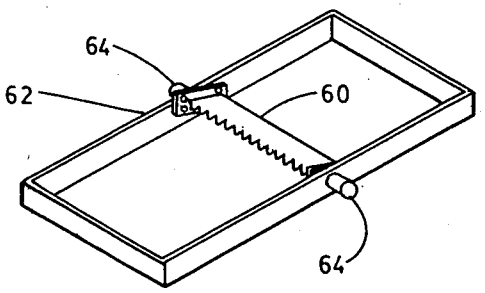
FIG. 8 is a view of the slicing blade and holder shown in isolation.

The blade assembly is shown in more detail in FIG. 8, and the details of the blade are shown in FIGS. 9 to 13.

As shown in FIG. 8, the blade is indicated generally as 60. It is shown mounted in a blade support frame 62. Frame 62 has stub axles 64 extending from opposite sides. Axles 64 are adjustably mounted on the side frames 12A and 12B and 14A and 14B.

It will be noted that the blade 60 is mounted in a plane tilted in an angle relative to the plane of frame 62. In this way with the blade passing on a more or less horizontal plane through the wooden workpiece, the frame is enabled locate itself around the exterior of the workpiece. Frame 62 pivots freely on the axles 64, enabling the blade to align itself automatically along the slicing plane behind the centres of axles 64.

A light spring (not shown) locates the frame 62, with the blade horizontal when the wooden workpiece is not present.

Referring now to FIGS. 9 to 13 and 15, the blade 60 will be seen to comprise a plurality of angled cutting edges 66 interspaced with v-shaped notches 68. The edges 66 are oriented along a slicing angle $\alpha$ as shown in FIG. 9, and are sharpened to a knife angle $\beta$ as shown in FIG. 10.

The blade 60 has a rearward edge 70 which is ground on its upper and lower sides to an angle $\theta$.

The blade is preferably made of metal with properties such as the metal known as "Stellite" (Trade Mark).

In order to secure the blade 60 in position and brace it against the very substantial stresses experienced in use the blade is preferably held in such a way that it is subjected to lateral tension transversely of the axis of movement of the workpiece. In order to achieve this the blade 60 is formed with grooves 72 along either side edge as shown in FIGS. 9 and 12.

Blade clamping bars 74 (FIG. 8) are clamped on opposite sides of the blade 60. The clamping bars 74 are then securely bolted to the sides of frame 62, in such a way as to apply lateral tension.

An alternate form of blade is shown in FIG. 13 wherein a plurality of notches 76 are formed along two generally angled converging axes as opposed to the straight transverse axis of the notches 68 in the FIG. 9 embodiment. This arrangement with the edges located along what are essentially V-shaped axes provides an inherent natural tensioning of the blade as a result of the stresses during slicing.

The use of relatively short edges on the blade is of particular importance, in practice.

The slicing of wood is most difficult, with a straight blade, i.e., a linear blade at 90 degree axis to the line of travel.

Slicing becomes progressively easier as the axis of the blade edge is swung away from 90 degrees. However, this will require a longer blade, and blade edge. This becomes harder to control, the blade may become more flexible, and it is more difficult to locate the blade within the "footprint", or pressure area of the pressure rolls.

Figure 15:
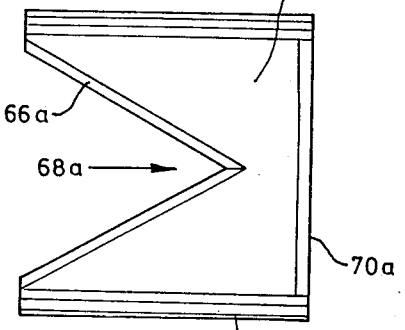

A blade 60*a* with a single v-shaped notch 68*a* as shown in FIG. 15 is a substantial improvement, over a straight blade. In this case, the blade length is reduced, dependant on the width of workpiece to be sliced, and excellent results can be obtained.

In the present invention each blade edge defines an optimum slicing angle

Each blade edge is relatively short, along the axis of movement. Consequently, each edge is stiffer and less liable to deflect in use than a continuous straight edge. By selecting a metal with suitable properties and by optimizing the tooth length and slicing angle it is possible to produce a blade which is both short, and therefore easier to control, and also slices at the optimum angle, and is therefore efficient.

Blade length is no longer a limiting factor on the width of slice as it was in earlier proposals.

In order to drive the wooden workpiece W through the apparatus, drive means are preferably provided for driving the pressure rolls, or at least one of the rolls in each pair, although many other forms of prime mover may be used for driving the workpiece.

In the present embodiment, such drive means comprises the electric motors and gear reducers 80 and 82 coupled to respective upper rolls 30 and 34 by chain drives 84 and 86.

The chain drive is so arranged as to permit a slight degree of vertical movement of the rolls, without altering the relationship of the sprockets.

In this embodiment, similar drive motor and chains (not shown) are provided for the lower rolls. Synchronism between drives is not a problem, and the rolls can simply be allowed to slip on the wood surface if they are not in synchronism.

Drive means are also provided for operating the nuts 25 in unison, so as to raise or lower, upper frames 20.

Such drive means comprises the four sprockets 26 connected to the nuts 25. Sprockets 26 are connected, in pairs, by drive chains 88, and drive shafts 90. Shafts 90 are connected by chains 92–94 to prime mover 96, in this case, another electric motor with a gear reducer.

In operation, the upper frame is set to the required spacing from the lower frame so that the workpiece W just passes between guides 27. The tires 56 are inflated to the necessary pressure.

The pressure medium may be air, gas, or a liquid medium for greater safety.

The pressure rolls, when idle, are centred by spring means (not shown), so as to align with the central axis of the workpiece.

The wooden workpiece W is then forced between the first pair of pressure rolls. They will apply pressure to opposite sides of the workpiece, and the first blade 60 will then enter the workpiece along a predetermined slicing plane.

As the workpiece is driven along, the workpiece will be sliced along the slicing plane defined by the leading edge of the first blade 60 tending to centre itself directly behind the centre of pivot stub axles 64.

The second blade 60 is located in a plane spaced apart from the plane defined by first blade 60. Thus when the wooden workpiece reaches second blade 60, and passes between the two rolls 32 and 34, it will again be subjected to pressure on both sides and forced against the blade 60.

The workpiece will then be ejected essentially as three separate wooden pieces or planks indicated as P.

Obviously, the number of planks produced will be one more than the number of slicing blades. As noted above, if only one slicing operation is required then the rolls 32 and 34 may be omitted or they may be simply opened up so that they do not engage the wooden workpiece and the second blade 60 would be removed.

In accordance with the invention, the pressure applied by the upper and lower rolls to the workpiece will be in the range of between 20% and 80% of the yield point of the wood.

It is found that for optimum use in most commercial soft wood, that the edge angle $\alpha$ should be in the range of from 10° to 80°, and that the blade sharpening angle $\beta$ of edges 66 should preferably be in the range of from about 15° to 45° from the direction of slicing.

The bevel angle $\theta$ of the rear edge should be in the region of 15° to 45°.

Knife detailed design applies standard engineering practice to keep overall thickness and length to their minima, while selecting slicing angle $\alpha$, knife edge angle $\beta$, and edge length commensurate with the strength properties of the knife material used and the wood to be sliced and achieving optimum slicing accuracy. As a rule of thumb tooth tip deflection as a cantilever beam fixed at its base and uniformly loaded on one side at the strength in compression parallel to grain (as an estimate of knot strength) of the wood to be sliced should not exceed 2% of the thickness of the knife.

Corners of the blade will be rounded, so as to minimize damage to the wood, and to reduce stress concentrations.

While this invention as illustrated shows two blades, spaced apart along the line of travel, it may also be possible to have two (or more) blades located spaced apart vertically, but between the same pair of pressure rolls.

The invention provides a substantial saving in wood, since no "kerf" is removed. The advantage becomes more significant with thinner slices, such as in wood siding, shingles, and lath.

The invention can also be used for trimming and shaping tree trunks or logs.

In this case the log must be gripped at opposite ends.

Figure 14:
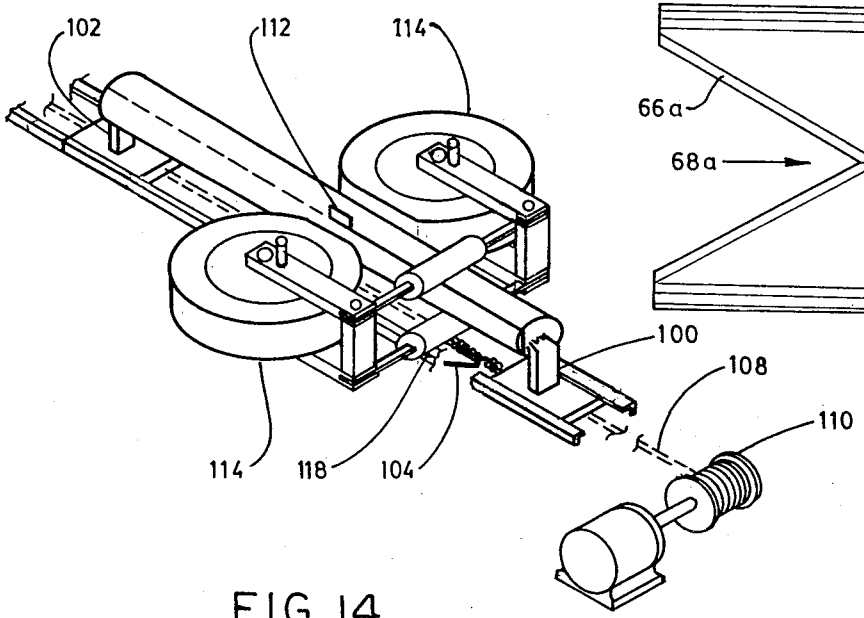
FIG. 14 is a schematic perspective of an alternate embodiment for slicing logs; and, FIG. 15 is a plan view of an alternate embodiment of a blade.

A form of apparatus suitable for the purpose is shown in FIG. 14.

It comprises a pair of end clamp jaws 100, 102 and a jaw tension member 104 extending therebetween which may be tensioned at various lengths. A traction device such as chain 108 and drum 110 may be used to drag the log. A blade 112, and pressure wheels 114 are located in the path of the log. The wheels 114 would be movable away from the log as its diameter increased, by a suitable automatic compensator. This could comprise a link 116, similar to link 54, having a pressure sensitive adjuster, e.g. a hydraulic cylinder 118 by means of which the link could be extended and retracted as needed.

Guide means such as guide rails 120 engage the clamps 100, 102 and constrain them to move along a defined linear path. The pressure pad wheels 114 are free to "float" or move independently of the linear path of movement and thus equalise the force on opposite sides of the blade.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A method of slicing wood comprising the steps of:

moving a wooden workpiece constrained to follow a linear path parallel to the intended plane of slicing;

forcing one end of said workpiece against a blade directed longitudinally along the grain;

applying pressure on both sides of said wooden workpiece, on opposite sides of said blade, by means of pressure means, and, allowing said pressure means to move relative to said blade, while maintaining equal spacing between themselves, whereby to equalize the compressive force on both sides of said wooden workpiece in the region of the blade.

2. A method as claimed in claim 1 wherein said workpiece is guided and constrained by fixed guide means on opposite sides, so as to move along a defined linear axis, while said pressure means are free to move relative to said workpiece.

3. A method as claimed in claim 1 wherein said pressure means are linked together for movement in unison with one another whereby when one pressure means moves towards said workpiece the other said pressure means moves away.

4. A method as claimed in claim 1 including the further step of forcing said wooden workpiece against at least one further said blade spaced axially along the line of travel from said first blade, and subjecting said wooden workpiece to pressure on opposite sides thereof in the region of said at least one further blade, said further blade lying in a plane spaced from the plane of said first blade, whereby to slice said wooden workpiece along multiple parallel spaced apart slicing paths.

5. Apparatus for slicing a wooden workpiece moving on a defined linear path and comprising:

blade means and blade mounting means for locating said blade means in the path of a wooden workpiece;

two opposed pressure means, located on opposite sides of said wooden workpiece, for applying pressure to opposite sides thereof;

moveable mounting means mounting each of said pressure means, for movement towards and away from said workpiece, and, force equalizing means operatively coupled to said pressure means for equalizing force on both sides of said workpiece.

6. Apparatus as claimed in claim 5 including link means operatively connecting said pressure means, whereby they are moveable in unison, while maintaining equal spacing therebetween.

7. Apparatus as claimed in claim 6 including adjustment means for adjusting the spacing between said pressure means to accommodate wooden workpieces of different dimensions.

8. Apparatus as claimed in claim 5 including at least one further said blade means and at least one further said pair of pressure means, spaced apart along the line of travel of said wooden workpiece, and said at least one further blade means being located in a plane spaced apart from the plane of said first blade means.

9. Apparatus as claimed in claim 5 wherein said blade mounting means comprises a generally rectangular blade mounting frame, and stub axles extending outwardly from either side of said blade mounting frame, and bearing means receiving said stub axle means.

10. Apparatus as claimed in claim 9 including a flat blade, edge means on a leading edge of said blade for slicing said workpiece, and blade clamping means on opposite edges of said blade, said clamping means being fastened to said frame.

11. Apparatus as claimed in claim 10 wherein said edge is formed by a plurality of angled cutting edges defining at least two slicing edges located at a slicing angle oblique to the line of travel of said workpiece.

12. Apparatus as claimed in claim 5 wherein said pressure means comprises rotatable wheel hubs, and inflatable tires mounted on said hubs.

13. Apparatus as claimed in claim 5 wherein said moveable mounting means comprise pairs of tilt bans on opposite sides of each of said pressure means, stub axles extending outwardly from tilt bars, bearing means for receiving said stub axles, said pressure pad means being mounted on one end of said tilt bars, and said tilt bars extending to free ends opposite said pressure pad means, and link means interconnecting said free ends of said tilt bans of opposed pressure means, whereby the same may tilt on respective pairs of tilt bans in unison.

14. Apparatus as claimed in claim 13 wherein said pressure means are rotatable, and including power drive means for rotatably driving the same.

15. Apparatus as claimed in claim 5 including guide means adapted to engage opposite sides of said wooden workpiece, and define a constrained linear path of travel, said pressure means being mounted independently of said guide means, and being moveable in unison relative to said path of travel.

16. Apparatus as claimed in claim 5 including upper and lower mounting frame means, said lower frame means carrying a lower one of said pressure means said guide means and said upper mounting frame means carrying an upper one of said pressure means and said guide means, one of said upper and lower mounting frame means being moveable relative to the other, whereby to vary the spacing therebetween and to accommodate wooden workpiece of varying dimension.

17. Apparatus as claimed in claim 16 including power operated drive means for moving one of said upper and lower mounting frame means relative to the other.

18. Apparatus as claimed in claim 1 wherein said wooden workpiece is a log, and including log end clamping means for clamping opposite ends of said log, and transport means engagable with said log clamping means for transporting said log clamping means and a log clamped therebetween along a predetermined slicing axis.

* * * * *